US005787923A

United States Patent [19]

Shea et al.

[11] Patent Number: 5,787,923

[45] Date of Patent: Aug. 4, 1998

[54] HOSE REEL ASSEMBLY

[75] Inventors: Robert F. Shea, Florissant, Mo.; Steven W. Post, Jonesboro, Ark.

[73] Assignee: McNeil (Ohio) Corporation, St. Paul, Minn.

[21] Appl. No.: 767,474

[22] Filed: Dec. 16, 1996

[51] Int. Cl.[6] ..... B65H 75/48; E03B 1/00

[52] U.S. Cl. ..... 137/355.26; 137/355.23; 137/580

[58] Field of Search ..... 137/355.23, 580, 137/355.26, 15

[56] References Cited

U.S. PATENT DOCUMENTS

| | | | |
|---|---|---|---|
| 1,675,140 | 6/1928 | Schenderlein | 137/355.23 |
| 1,982,610 | 11/1934 | Harris | 137/355.23 |
| 2,590,963 | 4/1952 | Hannay | 242/87 |
| 3,314,562 | 4/1967 | Farmer | 214/650 |
| 3,493,009 | 2/1970 | Richardson | 137/355.17 |
| 3,552,425 | 1/1971 | Olson | 137/355.17 |
| 3,709,252 | 1/1973 | Bishop | 137/355.17 |
| 4,224,960 | 9/1980 | Nederman | 137/355.23 |
| 4,446,884 | 5/1984 | Rader, Jr. | 137/355.16 |
| 4,487,218 | 12/1984 | Sifri | 137/355.26 |
| 4,506,698 | 3/1985 | Garcia et al. | 137/355.26 |
| 4,512,361 | 4/1985 | Tisbo et al. | 137/580 |
| 5,392,808 | 2/1995 | Pierce | 137/355.23 |

*Primary Examiner*—A. Michael Chambers
*Attorney, Agent, or Firm*—Senniger, Powers, Leavitt & Roedel

[57] ABSTRACT

A hose reel assembly for taking up and feeding out a hose. The assembly includes a non-rotatable shaft having opposite ends, a reel for storing the hose rotatable on the shaft and a hub mounted on the shaft at one side of the reel between the reel and one end of the shaft so that the hub may be slidably applied to and removed from the shaft independent of the reel. The assembly further includes a coupling on the hub for connecting the hub and the hose. The shaft and the hub include passaging for supplying fluid to the hose. A seal is provided between the shaft and the hub adjacent to the passaging for preventing fluid leakage. The hub is releasably connected to the reel for conjoint rotation of the hub and the reel on the shaft and is disconnectable from the reel so that the hub may be removed from one end of the shaft to permit replacement of the seal without removing the reel from the shaft.

11 Claims, 5 Drawing Sheets

154
150
18
12
25
80
88
10
116
24
92
82
86
128
22
26
108
134
54
32
40
27
16
138
136
132
14
20
90
70
106
144
102
84
145
107
146
116
107
149
96
83
88
100
98
12
88
151
148
151

154
24
10
88
142
128
126
106
106
116
16
116
140
144
106
106
145
80
18
149
86
25
148

HOSE REEL ASSEMBLY

BACKGROUND OF THE INVENTION

This invention relates generally to hose reels for taking up, storing and feeding out hose and other flexible tubing, and more specifically to a hose reel assembly in which the hose reel is rotatably mounted on a stationary shaft through which fluid is transferred from a fluid source to a hose wound up on the reel.

Generally, hose reel assemblies of conventional design include a shaft, a reel for storing hose rotatable on the shaft, one or more hubs rotatable with the reel on the shaft, and flow passages in the shaft and hub(s) for transfer of fluid from an external source to the hose. Sealing members such as O-rings are generally disposed around the shaft for preventing fluid leakage in the hub areas. As is typical with hydraulic components, the O-rings lose their sealing effectiveness over time and must be replaced. Replacing these seals in a reel assembly of conventional design is cumbersome and time consuming because one or more hubs must be removed from the shaft, and these hubs are generally located at the center of the shaft surrounded by the reel or connected to the reel. As a result, replacement of the O-rings often requires not only removal of the reel and hub components from the shaft, but disassembly of much of the reel itself.

Accordingly, there is presently a need for a hose reel assembly in which the sealing members are more readily replaceable.

SUMMARY OF THE INVENTION

Among the several objects of this invention may be noted the provision of an improved hose reel assembly which is designed to permit quick and easy replacement of the sealing members to minimize maintenance time; the provision of a hose reel assembly which is of a relatively simple construction and requires fewer parts; and the provision of a hose reel assembly which is less costly to manufacture.

Generally, a hose reel assembly of the present invention is designed for taking up and feeding out a hose. The hose reel assembly includes a non-rotatable shaft having opposite ends, a reel for storing the hose rotatable on the shaft and a hub mounted on the shaft at one side of the reel between the reel and one end of the shaft so that the hub may be slidably applied to and removed from the shaft independent of the reel. The reel assembly further includes a coupling on the hub for connecting the hub and the hose. The shaft and hub include passaging for supplying fluid to the hose. A sealing member is located between the shaft and the hub adjacent the passaging for preventing fluid leakage. The hub is connected to the reel for conjoint rotation of the hub and the reel on the shaft and is disconnectable from the reel so that the hub may be removed from one end of the shaft to permit replacement of the seal without removing the reel from the shaft.

The present invention also involves a method of replacing at least one sealing member of the hose reel assembly described above. The method includes the steps of disconnecting the hub from the reel, removing the hub from the shaft without removing the reel, replacing the sealing member, and replacing the hub on the shaft and reconnecting the hub to the reel.

Other objects and features will be in part apparent and in part pointed out hereinafter.

BRIEF DESCRIPTION OF THE DRAWINGS

Corresponding parts are designated by corresponding reference numerals in the several views of the drawings.

DETAILED DESCRIPTION OF THE PREFERRED EMBODIMENT

Figure 1:
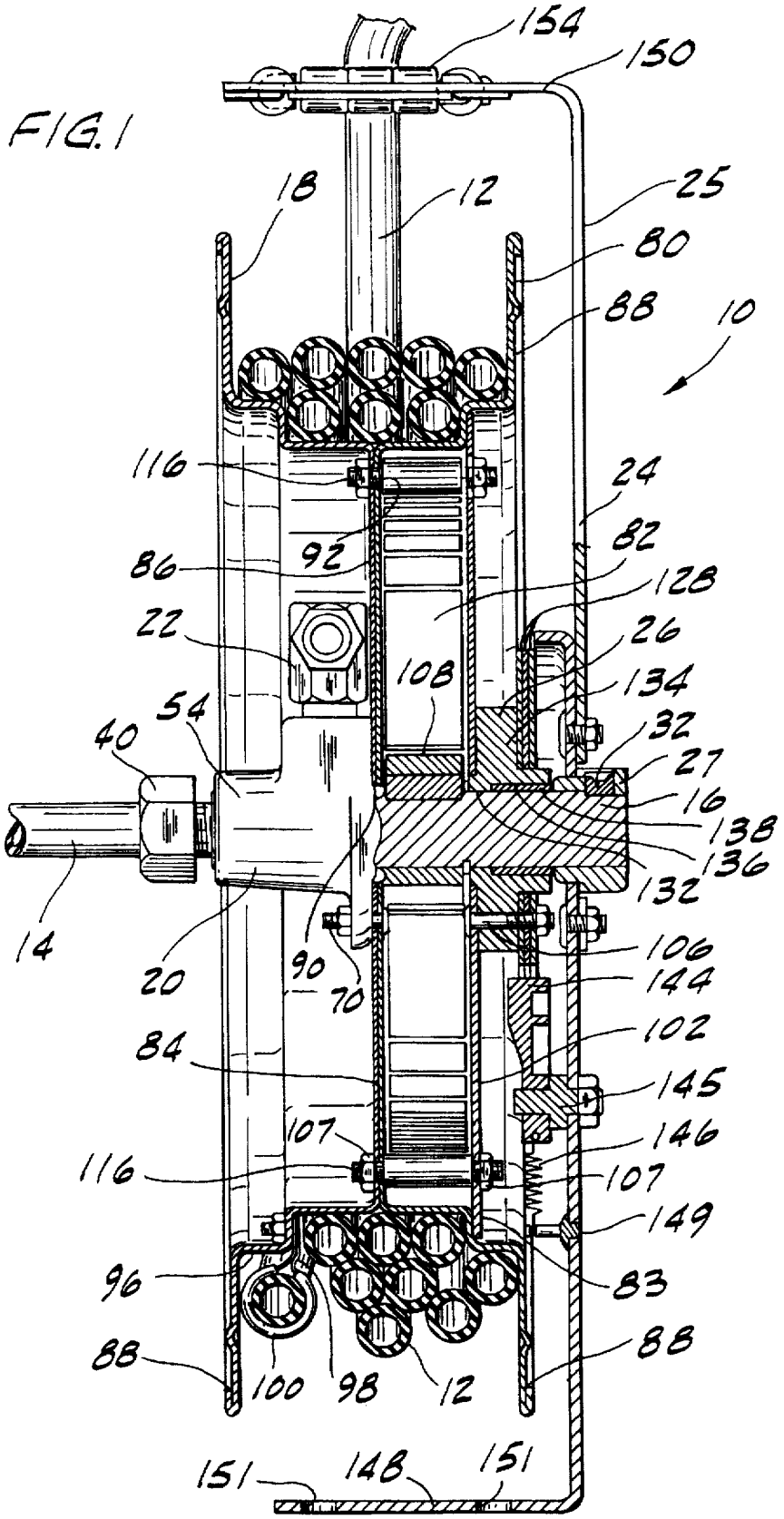
FIG. 1 is a side view of a hose reel assembly of the present invention showing hose stored on a reel of the assembly, parts of the assembly being broken away to show detail.

Referring now to the drawings, and first to FIG. 1, there is generally indicated at 10 a hose reel assembly of this invention for taking up and feeding out a flexible conduit, such as a hose 12 or other tubing, and transferring fluid such as oil, water or air from a fluid supply line 14 to the hose. The hose reel assembly 10 includes a non-rotatable shaft 16, a reel 18 for storing the hose 12 rotatable on the shaft, a hose connection hub 20 mounted on the shaft, and a coupling 22 on the hub for connecting the hose to the hub. Passaging is formed in the shaft 16 and hose connection hub 20 for supplying fluid from the fluid supply line 14 to the hose. The hose reel assembly 10 also includes a support bracket 24 for mounting the assembly on a flat surface such as a floor or wall.

The shaft 16 of the hose reel assembly 10 supports the hose connection hub 20, reel 18 and a latch hub 26 which will be described in more detail below. As viewed in FIG. 2, the right end 17 of the shaft 16 is fixedly mounted within a shaft support ring 27 received in an opening in a vertical member 25 of the support bracket 24 and welded in place to the support bracket. A radial opening 28 extends from the outer surface of the support ring 27 to an inner bore 29 in which the shaft 16 is received. This opening 28 is aligned with a flat 30 formed on the shaft 16 adjacent to the end 17 of the shaft received in the support ring 27. A set screw 32 threaded in the opening 28 is engageable with the flat 30 to retain the shaft 16 in a fixed position relative to the support ring 26 and support bracket 24, thus preventing rotation of the shaft.

A first fluid passage 34 extends axially inwardly from the opposite end 19 of the shaft (its left end as viewed in FIG. 2) for receiving fluid from the fluid supply line 14. The inlet end 36 of the axial passage 34 is formed with threads 38 engageable with a connector 40 on the fluid supply line 14. A radial passage 42 extends perpendicular to and through the axial fluid passage 34 adjacent its downstream end for connecting the axial passage to a wide annular groove or channel 44 which extends around the circumference of the shaft 16. The channel 44 provides for fluid communication between the shaft 16 and the hose connection hub 20 as the hub rotates around the shaft. The axial passage 34, radial passage 42 and channel 44 are sized to provide sufficient flow under standard operating pressures. The diameter of the shaft 16 is sized to provide adequate wall thickness between the axial passage 34 and the outer surface of the shaft and to provide sufficient strength to support the reel 18. The shaft 16 is preferably of one-piece construction, and preferably formed from corrosion resistant steel.

Two relatively narrow circular seal grooves 46, 48 are formed in the shaft 16 generally adjacent to and on opposite sides of the annular channel 44 for receiving sealing members for preventing fluid leakage from between the hose connection hub 20 and the shaft. The seal groove 46 located closest the inlet end 19 of the shaft 16 is sized to include an O-ring 50 and a back-up ring 52 to prevent extrusion of the O-ring into the diametrical clearance between the hub 20 and the shaft due to the pressure differential across the O-ring. The seal groove 48 located on the other side of the channel 44 includes only an O-ring 50. It is to be understood that other O-ring 50 and back-up ring 52 configurations and arrangements may be used without departing from the scope of this invention.

As shown in FIG. 1, the reel 18 is interposed between and connected to the hose connection hub 20 and to the latch hub 26 for conjoint rotation of the reel 18 and the two hubs on the shaft 16. The hose connection hub 20 is removably mounted on the inlet end 19 of the shaft 16 so that the hub may be slidably applied to and removed from the shaft independent of the reel 18 to permit replacement of the O-rings 50 and back-up ring 52 without removing the reel from the shaft.

Figure 2:
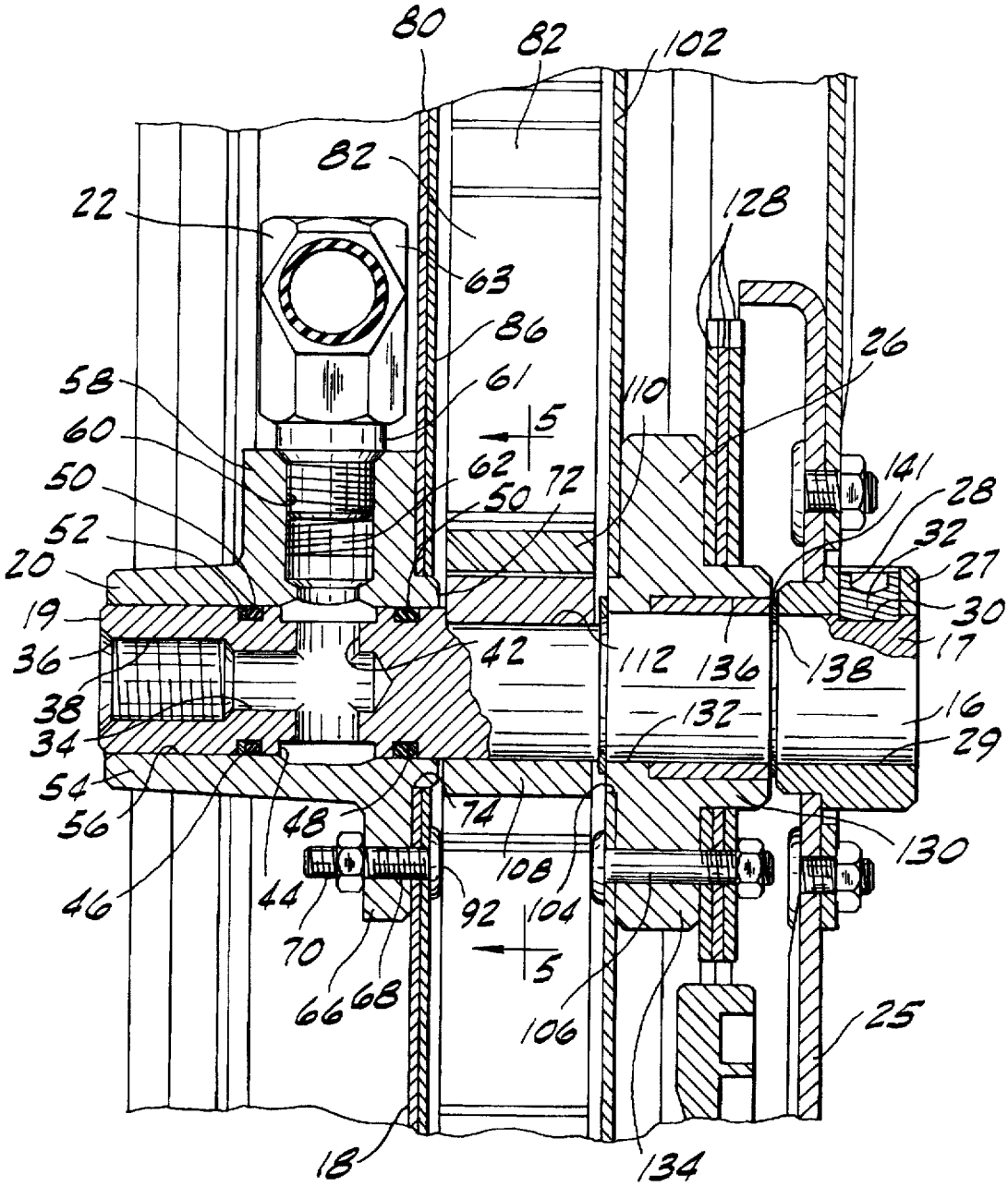
FIG. 2 is an enlarged cross-sectional view of a portion of the hose reel assembly of FIG. 1.

The hose connection hub 20 comprises a hub body 54 having an axial bore 56 therethrough for receiving the shaft 16 and a boss 58 on the body having a bore 60 therethrough extending generally radially with respect to the shaft 16 and constituting a second fluid passage (FIG. 2). The second fluid passage 60 communicates with the hose coupling 22 and with the annular channel 44 in the shaft 16 throughout rotation of the hose connection hub 20 on the shaft. Internal threads 62 are formed in the second fluid passage 60 for mating with external threads on a connector 61 located at one end of the coupling 22. The other end of the coupling has a connector 63 for attachment to the hose 12 and may be replaced with different size connectors for attachment to different diameter hoses. The coupling 22 is removably connected to the hub 20 for easy replacement of the coupling if required due to damage or wear to the coupling.

Figure 3:
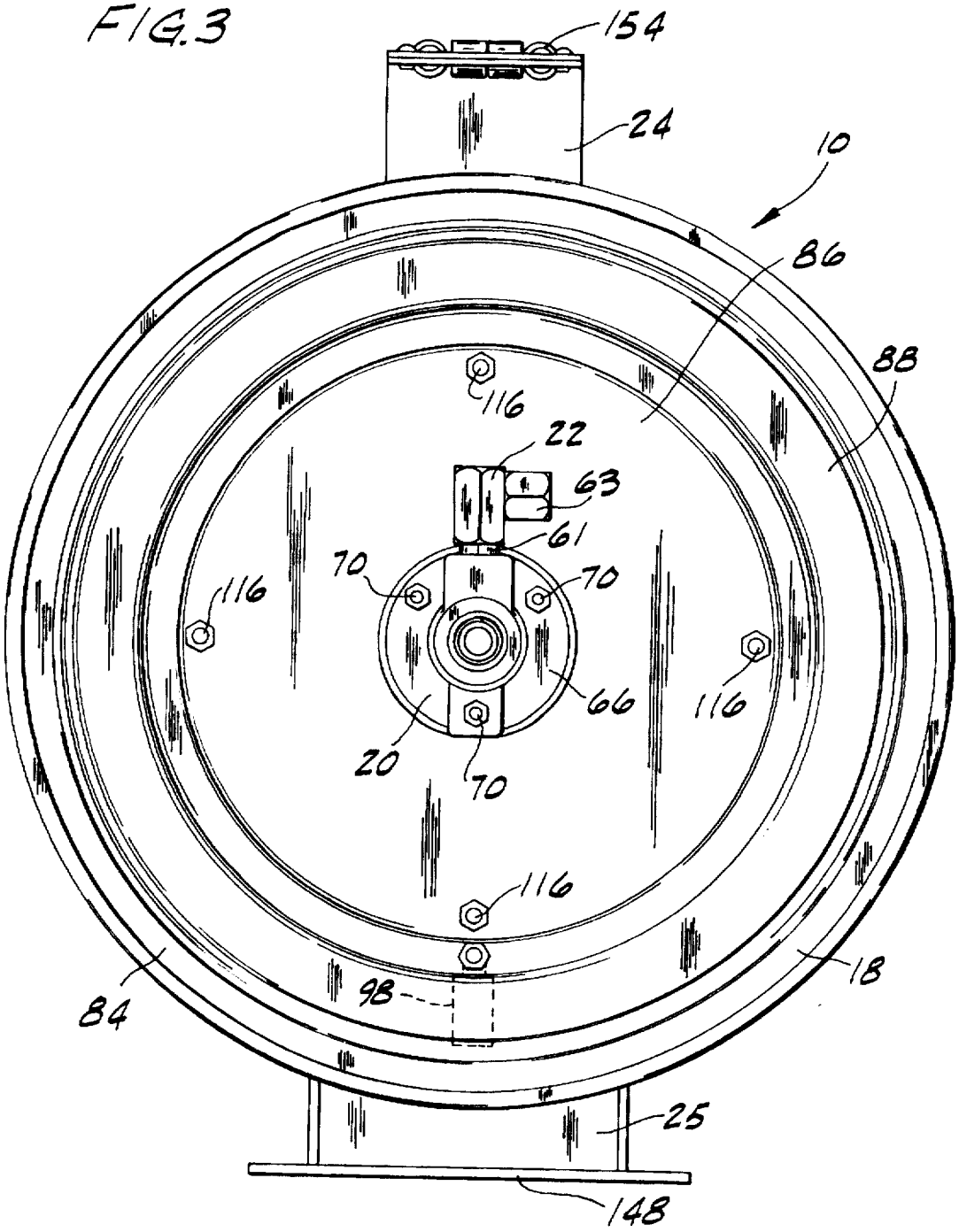
FIG. 3 is a front view of the hose reel assembly of FIG. 1.

The hose connection hub 20 also includes a radial fastening flange 66 which has three openings 68 formed therein for receiving fasteners 70 for connecting the hub to the reel 18 (FIG. 3). The fasteners 70 may be bolts and nuts or any other suitable fasteners. It is to be understood that the design of the flange 66 and the number, arrangement and types of fasteners 70 used to connect the hub 20 to the reel 18 may vary without departing from the scope of this invention. The end of the hub body 54 adjacent to the flange 66 is formed with a circular rib 72 extending axially from the body for insertion into a central opening 74 in the reel 18 for proper positioning of the reel with respect to the hub 20. The hub 20 is preferably formed from a corrosion resistant steel which is compatible with the material of the shaft 16 to prevent wear of the hub and the shaft over time. Appropriate lubricant should be applied to the bore 56 of the hub 20 prior to placement of the hub on the shaft 16.

The reel 18 comprises a hose carrier, generally designated 80, for supporting the hose 12, and a spiral spring 82 for rotating the reel to wind the hose up on the reel (FIG. 1). The hose carrier 80 includes two opposing circular hubcap shaped members 84 having central generally flat portions 86 connected to one another, and opposing outer bent rim portions 88. The central flat portions 86 each have a central opening 74 sized for receiving the shaft 16 and the protruding rib 72 on the hose connection hub 20, and three openings 92 aligned with the openings 68 in the fastening flange 66 of the hub for receiving the fasteners 70 which connect the hub to the reel 18. The two bent rim portions 88 cooperate to define a generally U-shaped opening 96 or channel around the outer periphery of the hose carrier 80 for receiving and storing the hose 12. The members 84 may have an outer diameter of 19.50 inches, for example, and are preferably formed from sheet metal but may be formed from other materials such as a polymeric material or may be formed in different shapes and sizes without departing from the scope of this invention. The member 84 closest to the inlet end 19 of the shaft 16 has a hose clamp 98 attached to the bent rim portion 88 of the member for securing the hose 12 to the reel 18. The hose clamp 98 is a conventional metal loop-type clamp with a teflon or rubber lining 100, but it is to be understood that the type of clamp and number of clamps may vary.

The spiral spring 82 is maintained within an enclosure defined in part by the central portion 86 of the right (FIG. 2) circular member 84 and in part by a spring cover plate 102 having an outer periphery 83 engageable with the outer bent rim portion 88 of the circular member. The spring cover plate 102 has a central opening 104 sized for receiving the shaft 16 and a protruding annular flange on the latch hub 26, and four openings 105 spaced at intervals around the plate for receiving fasteners 106 for attaching the cover plate to the latch hub. The cover plate 102 and central portions 86 of the circular members 84 are connected by four studs 116 which are held in place by nuts 107 (FIG. 1).

Figure 5:
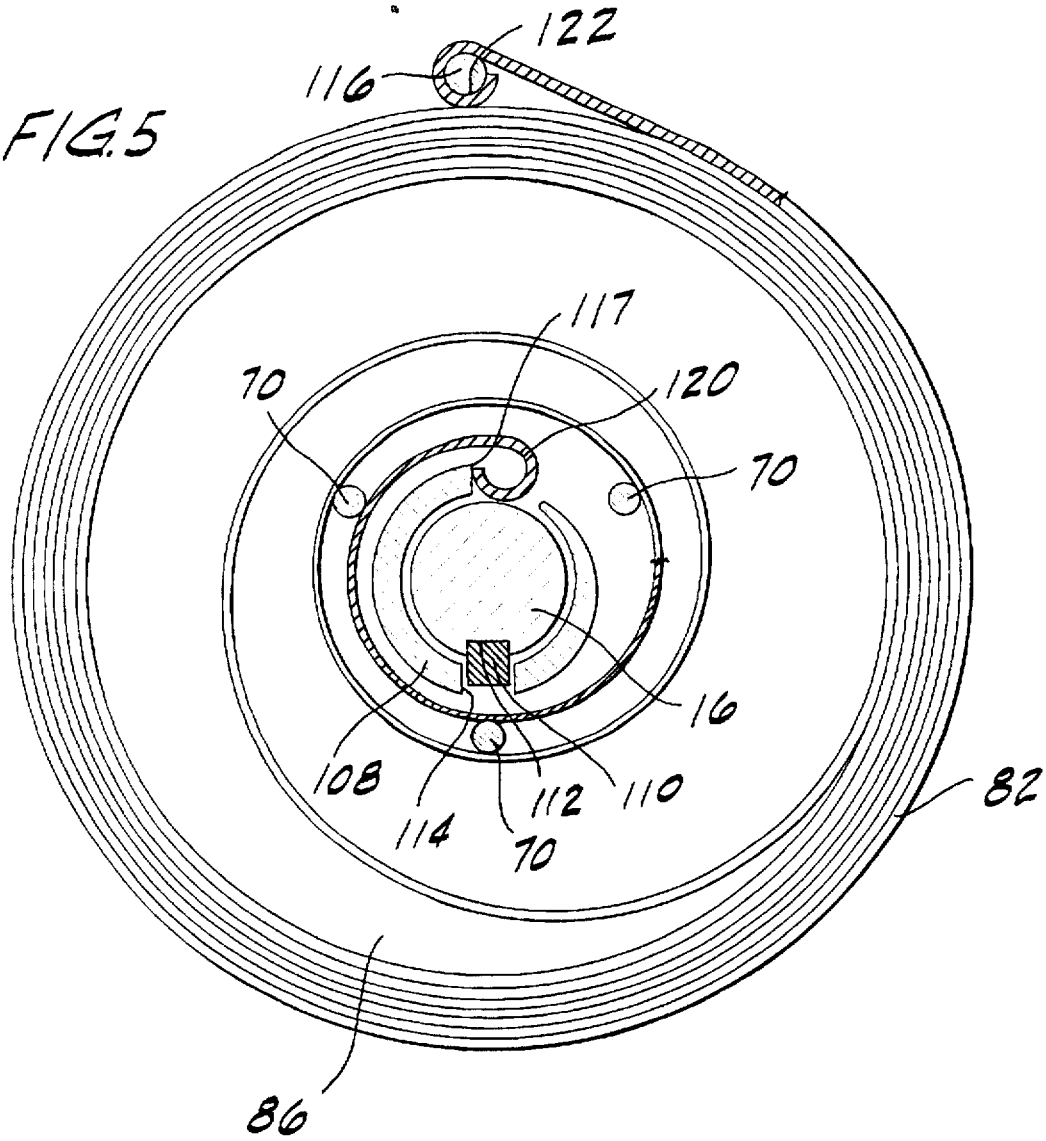
FIG. 5 is a cross-sectional view taken along line 5—5 of FIG. 2.

The reel 18 is rotatable on an arbor 108 interposed between the reel and the shaft 16. As shown in FIG. 5, the arbor 108 is generally C-shaped and fits over the shaft 16. The arbor is held against rotation relative to the shaft by an arbor key 110 received in a keyway 112 formed in the shaft. The arbor key 110 extends into an opening 114 in the arbor to prevent rotation of the arbor on the shaft 16. The spiral spring 82 is a torsion spring having an inner end 120 retained in an opening 117 located between the two ends of the arbor 108 and an outer end 122 which is wrapped around one of the studs 116 connecting the cover plate 102 and the central portion 86 of member 84.

Figure 4:
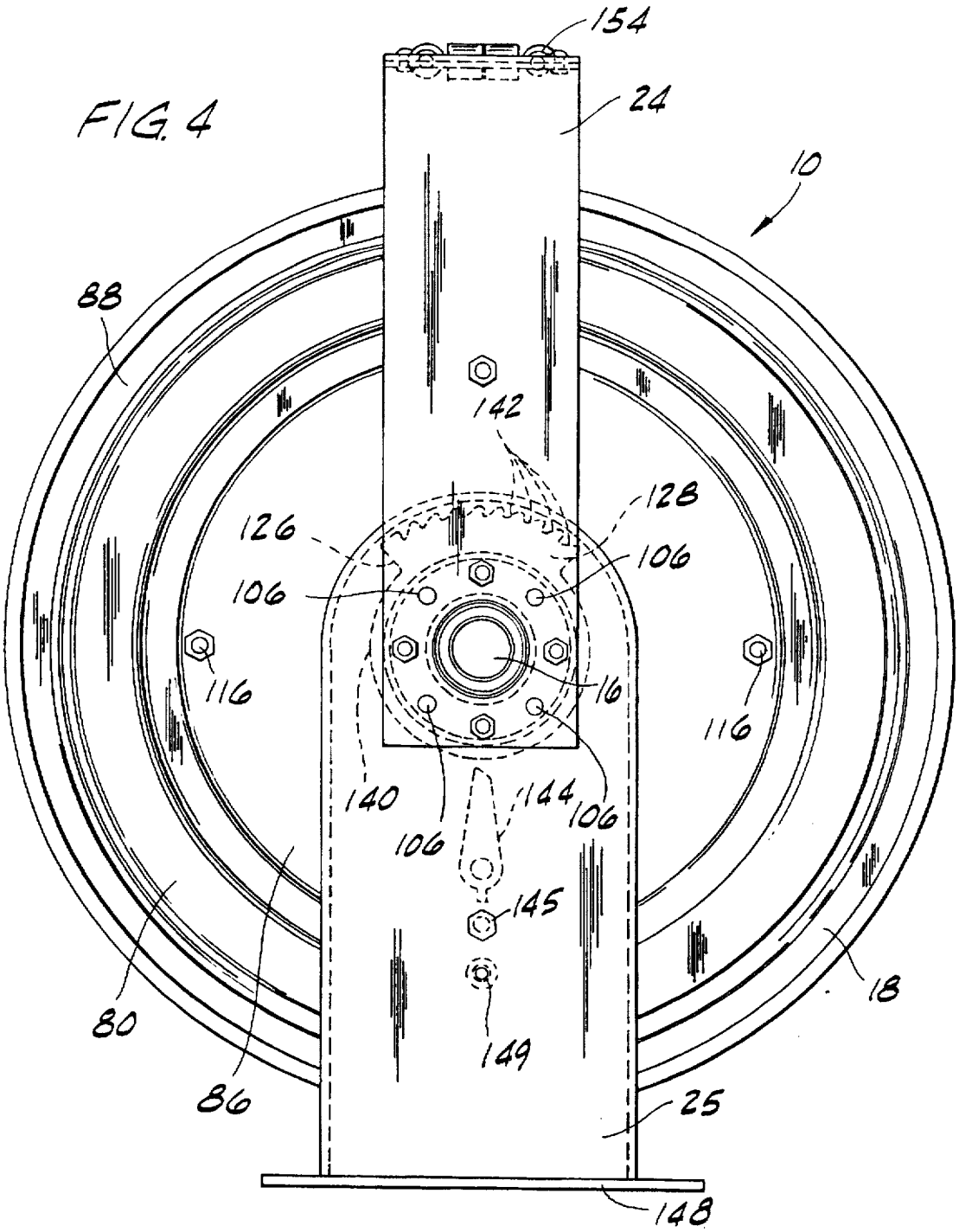
FIG. 4 is a rear view of the hose reel assembly of FIG. 1.

The latch hub 26 supports a ratchet wheel 126 comprising a series of parallel ratchet plates 128 formed with teeth 142 engageable by a pawl 144 to hold the reel 18 in a fixed position against the wind-up force exerted by the spring 82 (FIG. 4). The latch hub 26 includes a body 130 (FIG. 2) having an axial bore 132 therethrough for receiving the shaft 16, and a flange 134 for receiving the fasteners 106 connecting the latch hub and the spring cover plate 102. The latch hub 26 is formed with a counterbore 136 for receiving a bushing 138 fitted over the shaft 16. A retaining ring 141 is disposed adjacent to the latch hub for preventing axial movement of the latch hub. The ratchet wheel 126 is mounted on the latch hub 26 adjacent the flange 134 of the latch hub. The wheel is connected to the latch hub 26 by the same fasteners 106 connecting the latch hub and the spring cover plate 102. The ratchet wheel 126 has a smooth circular edge 140 except for one arcuate segment which is formed with the aforementioned teeth 142 (FIG. 4).

As shown in FIGS. 1 and 4, the pawl 144 is pivotally mounted on a pawl pin 145 fastened to the vertical member 25 of the support bracket 24. A coil tension spring 146 attached at one end to the support bracket 24 by pin 149 and at its other end to the pawl 144 urges the pawl toward a vertical position in which the pawl is engageable with the teeth 142 on the ratchet wheel. The operation of this ratchet wheel mechanism is conventional and will be understood by those skilled in this field, the arrangement being such that the inclined teeth on the ratchet wheel 126 move freely past the pawl 144 when the hose reel and ratchet wheel are rotated in a hose feed-out (unwind) direction. However, when the hose reel and ratchet wheel 126 rotate in the opposite (hose take-up) direction under the force exerted by the spiral spring 82, the pawl 144 releasably engages the teeth 142 in conventional fashion to temporarily latch the reel in a fixed position until the pawl and wheel are disengaged. It is to be understood that the configuration of the pawl 144, spring 146, and latching wheel 126 may vary and that other locking type mechanisms may be used without departing from the scope of this invention.

The support bracket 24 is designed for supporting the hose reel assembly on a horizontal surface such as a floor or table. The support bracket 24 is generally C-shaped and includes a horizontal base member 148, an upper horizontal member 150 and the vertical member 25 which connects the horizontal base member and the upper horizontal member. The vertical member 25 may have a height of 23.75 inches, for example. The base member 148 includes four mounting holes 151 each having a diameter of 0.468 inches, for example. Fasteners (not shown) are inserted into the mounting holes to attach the bracket to a supporting surface. The support bracket 24 can also be mounted on a vertical surface such as a wall, or hung on a roof or under a work bench. The upper horizontal member 150 of the support bracket 24 includes a roller assembly 154 for guiding the hose 12 as it is taken up on the reel 18 or fed out from the reel. The support bracket 24 may be made of metal, plastic or any other suitable material.

It will be apparent from the foregoing that the hose reel assembly of this invention is easy to operate and maintain. It will be especially noted in this regard that the sealing members 50, 52 are quickly and easily replaceable. This is accomplished by disconnecting the hose connection hub 20 from the reel 18 by removing fasteners 70 connecting the hub flange 66 to the reel, and removing the hub from the shaft 16. Removal of the reel is not necessary. The back-up ring 52 and O-rings 50 are then replaced with new O-rings and a new back-up ring, after which the hub 20 is replaced on the shaft 16 and fasteners 70 are reinserted in the openings in the hub flange 66 and the reel 18. This process may be repeated as frequently as necessary to prevent leakage of fluid between the hose connection hub 20 and the shaft 16.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A method of replacing at least one sealing member of a hose reel assembly of the type comprising a non-rotatable shaft, a hose storage reel rotatable on the shaft, a hub mounted on the shaft at one side of the reel, said hub being releasably connected to the reel between the reel and one end of the shaft, a coupling on the hub for connecting the hub and the hose, and passaging in the shaft and the hub for supplying fluid to the hose, said at least one sealing member being disposed between the shaft and the hub adjacent said passaging for preventing fluid leakage, said method comprising the steps of:

disconnecting the hub from the reel;

removing the hub from the shaft without removing the reel;

replacing said at least one sealing member;

replacing the hub on the shaft and reconnecting the hub to the reel.

2. A method as set forth in claim 1 wherein said step of replacing at least one sealing member comprises replacing two O-rings received in grooves on the shaft.

3. A hose reel assembly for taking up and feeding out a hose, said assembly comprising a non-rotatable shaft having opposite ends, a reel for storing the hose rotatable on the shaft, a removable hub rotatably mounted on the shaft at one side of the reel between the reel and one end of the shaft so that the hub may be slidably applied to and removed from the shaft independent of the reel, the shaft extending into the hub, a coupling on the hub for connecting the hub and the hose, passaging in the shaft and the hub for supplying fluid to the hose, seal means between the shaft and the hub adjacent said passaging for preventing fluid leakage, and means for releasably connecting the hub to the reel for conjoint rotation of the hub and the reel on the shaft, said hub being disconnectable from the reel so that the hub may be removed from said one end of the shaft to permit replacement of said seal means without removing the reel from the shaft.

4. A hose reel assembly as set forth in claim 3 wherein said passaging in the shaft comprises a first fluid passage extending axially through a portion of the shaft for receiving fluid external to the shaft, and an annular groove extending around the circumference of the shaft in communication with said first fluid passage.

5. A hose reel assembly as set forth in claim 4 wherein said first fluid passage has internal threads for mating with a connector on a fluid supply line.

6. A hose reel assembly as set forth in claim 4 wherein said passaging in the hub includes a second fluid passage in communication with the coupling and with said annular groove in the shaft throughout rotation of the hub on the shaft.

7. A hose reel assembly as set forth in claim 6 further comprising a second hub, separate from said removable hub, mounted on the shaft between the reel and a second end of the shaft.

8. A hose reel assembly as set forth in claim 7 further comprising a bearing interposed between the reel and the shaft for rotatably supporting the reel on the shaft, and the second hub being connected to the reel for conjoint rotation of the second hub, the reel and the first hub on the shaft.

9. A hose reel assembly as set forth in claim 6 wherein said hub comprises a body having an axial bore therethrough for receiving the shaft, a boss on the body having a bore therethrough extending generally radially with respect to the shaft and constituting said second fluid passage, and a fastening flange on the body having an opening therein, said means for releasably connecting the hub to the reel including at least one fastener receivable through said flange opening for connecting the hub to the reel.

10. A hose reel assembly as set forth in claim 4 wherein said seal means comprises two O-rings received in two annular seal grooves in the shaft disposed generally adjacent to and on opposite sides of said annular groove in the shaft.

11. A hose reel assembly as set forth in claim 3 further comprising a locking mechanism for holding the reel and removable hub in a selected fixed angular position of rotation relative to the shaft.

* * * * *